US008344625B2

(12) United States Patent
Espiau et al.

(10) Patent No.: US 8,344,625 B2
(45) Date of Patent: Jan. 1, 2013

(54) PLASMA LAMP WITH DIELECTRIC WAVEGUIDE BODY HAVING SHAPED CONFIGURATION

(75) Inventors: Frederick M. Espiau, Topanga, CA (US); Mehran Matloubian, Encino, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 305 days.

(21) Appl. No.: 12/824,441

(22) Filed: Jun. 28, 2010

(65) Prior Publication Data

US 2011/0204784 A1 Aug. 25, 2011

Related U.S. Application Data

(63) Continuation of application No. 12/484,174, filed on Jun. 12, 2009, now abandoned.

(51) Int. Cl.
*H01J 7/44* (2006.01)
*H05B 37/00* (2006.01)

(52) U.S. Cl. ..... 315/39; 315/40; 315/235; 315/248

(58) Field of Classification Search ..... 315/39, 315/40, 111.21, 112, 194, 234, 248; 313/153, 313/234, 634–636
See application file for complete search history.

(56) References Cited

U.S. PATENT DOCUMENTS

| | | | | |
|---|---|---|---|---|
| 4,975,655 | A | 12/1990 | Dawson et al. | |
| 5,686,793 | A | 11/1997 | Turner et al. | |
| 5,777,857 | A | 7/1998 | Degelmann | |
| 5,838,108 | A | 11/1998 | Frank et al. | |
| 5,886,480 | A | 3/1999 | Penzenstadler et al. | |
| 5,923,122 | A | 7/1999 | Frank et al. | |
| 6,241,369 | B1 | 6/2001 | Mackiewicz | |
| 6,617,806 | B2 | 9/2003 | Kirkpatrick et al. | |
| 6,737,809 | B2 | 5/2004 | Espiau et al. | |
| 6,922,021 | B2 | 7/2005 | Espiau et al. | |
| 7,119,641 | B2 | 10/2006 | Petrov et al. | |
| 7,348,732 | B2 | 3/2008 | Espiau et al. | |
| 7,350,936 | B2 | 4/2008 | Ducharme et al. | |
| 7,358,678 | B2 | 4/2008 | Espiau et al. | |
| 7,362,054 | B2 | 4/2008 | Espiau et al. | |
| 7,362,055 | B2 | 4/2008 | Espiau et al. | |
| 7,362,056 | B2 * | 4/2008 | Espiau et al. | 315/39 |
| 7,372,209 | B2 | 5/2008 | Espiau et al. | |
| 7,391,158 | B2 | 6/2008 | Espiau et al. | |
| 7,719,195 | B2 * | 5/2010 | DeVincentis et al. | 315/39 |
| 7,994,721 | B2 * | 8/2011 | Espiau et al. | 315/39 |
| 8,063,565 | B2 * | 11/2011 | Hafidi et al. | 313/635 |
| 8,084,955 | B2 * | 12/2011 | Ralston et al. | 315/248 |
| 8,143,801 | B2 * | 3/2012 | DeVincentis et al. | 315/248 |
| 2006/0250090 | A9 | 11/2006 | Guthrie | |
| 2010/0134008 | A1 * | 6/2010 | Espiau et al. | 315/39 |
| 2011/0204783 | A1 * | 8/2011 | Matloubian et al. | 315/39 |
| 2012/0086334 | A1 * | 4/2012 | DeVincentis | 315/40 |

* cited by examiner

*Primary Examiner* — Vibol Tan
(74) *Attorney, Agent, or Firm* — Kilpatrick Townsend & Stockton LLP

(57) ABSTRACT

A plasma lamp apparatus that includes an improved bulb support assembly to increase the lumens per watt output of the apparatus. The bulb support assembly includes a support structure that forms a cavity for receiving the bulb. The bulb is supported within the cavity though a protrusion that extends out from the support structure in a curved manner. By created a curved protrusion, the electric field within the resonating structure of the lamp apparatus is lowered. Lowering the electric field leads to lower resonating frequencies of the resonating structure. In lowering the resonating frequency, the resonating structure is driven to resonate at lower power levels, thereby increasing the lumens per watt output of the lamp apparatus.

19 Claims, 11 Drawing Sheets

PLASMA LAMP WITH DIELECTRIC WAVEGUIDE BODY HAVING SHAPED CONFIGURATION

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates generally to lighting techniques. In particular, the present invention provides a method and device using a plasma lighting device having a dielectric waveguide body having a shaped configuration. Merely by way of example, the invention can be applied to a variety of applications including a warehouse lamp, stadium lamp, lamps in small and large buildings, and other applications.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, who is the greatest inventor of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode, which is a solid state lamp. The blue light emitting diode forms a basis for the white solid state light, which is often a blue light emitting diode within a bulb coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrode-less lamp, which can be used to discharge light for high intensity applications. Matt was one of the pioneers that developed an improved electrode-less lamp. Such electrode-less lamp relied upon a solid ceramic resonator structure, which was coupled to a fill enclosed in a bulb. The bulb was coupled to the resonator structure via rf feeds, which transferred power to the fill to cause it to discharge high intensity lighting. The solid ceramic resonator structure has been limited to a dielectric constant of greater 2. An example of such a solid ceramic waveguide is described in U.S. Pat. No. 7,362,056, which is hereby incorporated by reference herein. Although somewhat successful, the electrode-less lamp still had many limitations. As an example, electrode-less lamps have not been successfully deployed. Additionally, the conventional lamp also uses a high frequency and has a relatively large size, which is often cumbersome and difficult to manufacture and use. These and other limitations of the conventional lamp are described throughout the present specification and more particularly below.

From the above, it is seen that improved techniques for lighting are highly desired.

BRIEF SUMMARY OF THE INVENTION

According to the present invention, techniques for lighting are provided. In particular, the present invention provides a method and device using a plasma lighting device having a dielectric waveguide body having a shaped configuration. Merely by way of example, the invention can be applied to a variety of applications including a warehouse lamp, stadium lamp, lamps in small and large buildings, and other applications.

In a specific embodiment, the present invention provides a plasma lamp apparatus. The lamp apparatus has a body comprising at least a dielectric material and having at least a main part with a first surface and a second surface opposed to the first surface. The apparatus has a feed inserted through the first surface into the main part of the body and configured to provide radio frequency energy to the body. In a preferred embodiment, a protruding portion of the dielectric material surrounding a periphery of a bulb. Preferably, the bulb has a first end, a second end, and a spatial region between the first end and the second end, and a predefined volume, the bulb enclosing a gas fill positioned to receive the radio frequency energy from the body such that a substantial portion of the electric field is provided within a vicinity of the spatial region. In a specific embodiment, the second surface is coated with an electrically conductive material. In a specific embodiment, the apparatus has at least a portion of the bulb enclosing the gas fill positioned above the main part of the body adjacent to the second surface and an rf power source coupled to the second surface to provide radio frequency energy to the body to cause the gas fill to emit a substantial portion of electromagnetic radiation of at least a determined amount of lumens per watt through a portion of the spatial region.

The present invention provides a dielectric support structure in which the bulb sits in. the bulb is supported in the structure through a protrusion that extends from the inner cavity of the support structure and makes contact around the periphery of the bulb. The protrusion extends from the support structure in a curved manner, thereby reducing the electric field that is generated at such protrusion. By reducing the electric field, the plasma is generated in the bulb at lower RF power levels, thereby increasing the lumens per watt characteristic of the lamp apparatus. Of course, there can be other variations, modifications, and alternatives.

Benefits are achieved over pre-existing techniques using the present invention. In a specific embodiment, the present invention provides a method and device having configurations of input, output, and feedback coupling elements that provide for electromagnetic coupling to the bulb whose power transfer and frequency resonance characteristics that are largely dependent upon a waveguide body having at least two materials. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for street lighting applications. In a specific embodiment, the present method and resulting structure are relatively simple and cost effective to manufacture for commercial applications. In a preferred embodiment, the invention provides a resulting device and method having a higher efficiency using rounded spatial features within one or more portions of the resonator structure to reduce electric fields and the like. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

According to the present invention, techniques for lighting are provided. In particular, the present invention provides a method and device using a plasma lighting device having a dielectric waveguide body having a shaped configuration. Merely by way of example, the invention can be applied to a variety of applications including a warehouse lamp, stadium lamp, lamps in small and large buildings, and other applications.

According to the present invention, techniques for lighting are provided. In particular, the present invention provides a method and device using a plasma lighting device having a dielectric waveguide of a dielectric constant of less than 2. More particularly, the present invention provides a method and apparatus having a plasma lighting device using a ceramic resonator structure of a dielectric constant of less than 2. Merely by way of example, the invention can be applied to a variety of applications including a warehouse lamp, stadium lamp, lamps in small and large buildings, and other applications.

Figure 1:
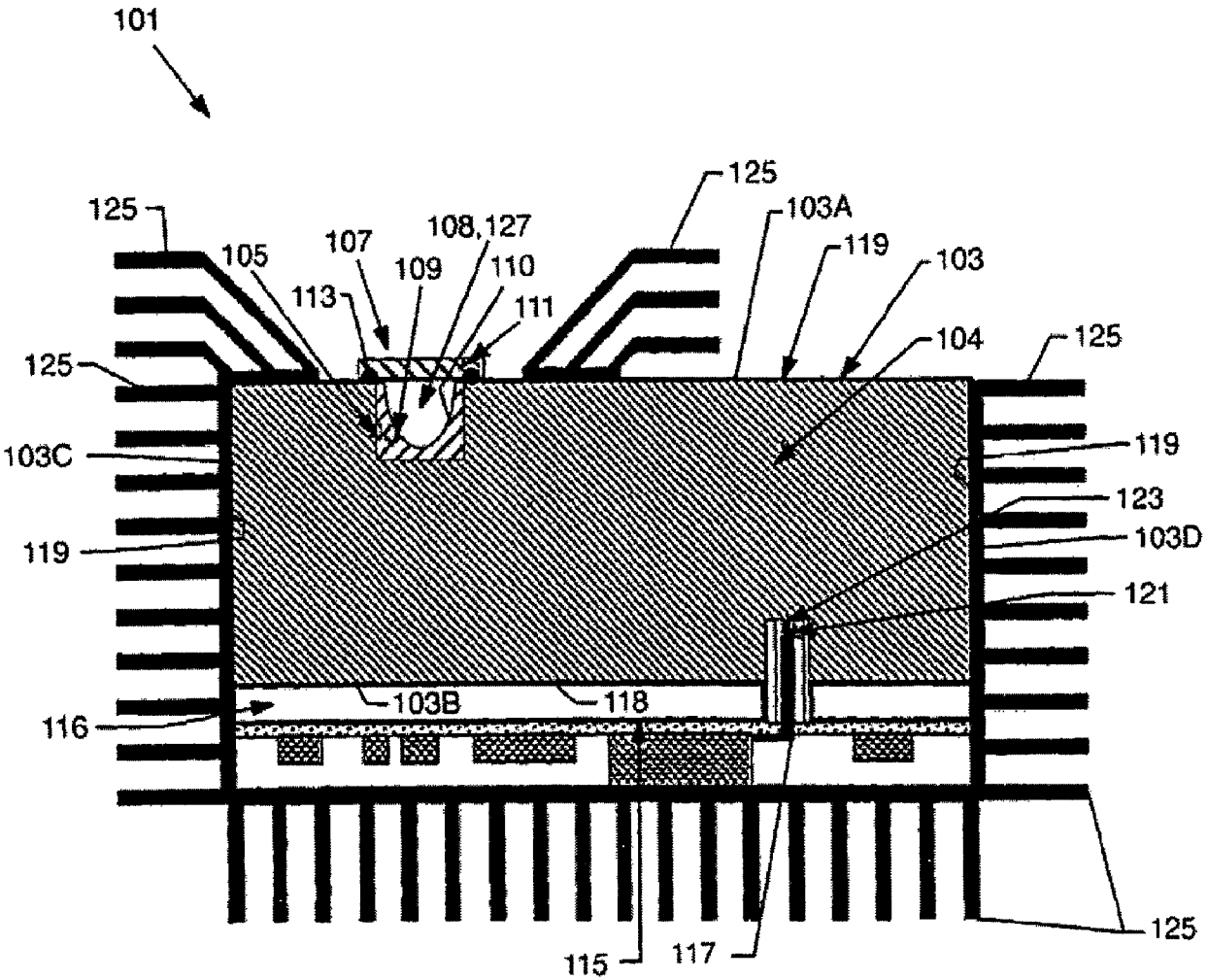
FIG. 1 illustrates a sectional view of a plasma lamp according to a preferred embodiment.

Turning now to the drawings, FIG. 1 illustrates a preferred embodiment of a dielectric waveguide integrated plasma lamp 101 (DWIPL). The DWIPL 101 preferably comprises a source 115 of electromagnetic radiation, preferably microwave radiation, a waveguide 103 having a body formed of a dielectric material, and a feed 117 coupling the radiation source 115 to the waveguide 103. As used herein, the term "waveguide" generally refers to any device having a characteristic and purpose of at least partially confining electromagnetic energy. The DWIPL 101 further includes a bulb 107, that is preferably disposed on an opposing side of the waveguide 103, and contains a gas-fill, preferably comprising a noble gas and a light emitter, which when receiving electromagnetic energy at a specific frequency and intensity forms a plasma and emits light.

Figure 1A:
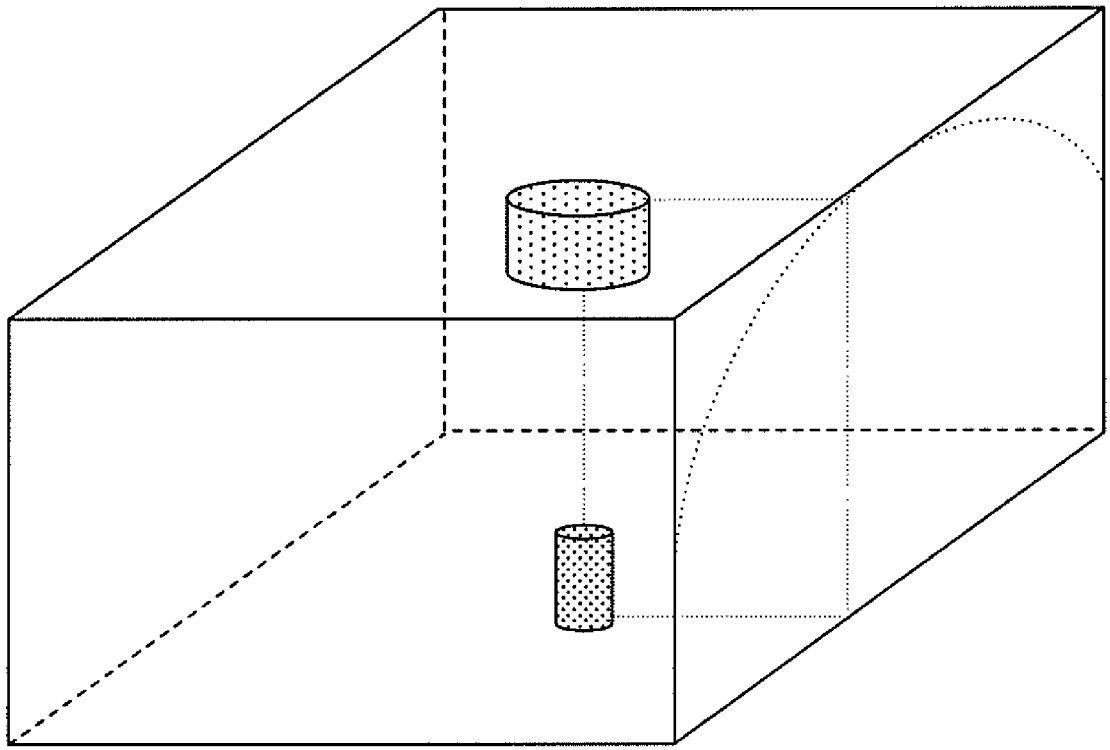
FIG. 1A is a simplified diagram of a waveguide body including a first material and a second material according to a specific embodiment of the present invention.

In a preferred embodiment referring to FIG. 1A, the dielectric waveguide body includes at least a first material and a second material. In a preferred embodiment, one of the materials is a dielectric constant of 2 and less. Depending upon the embodiment, the material can include a fluid, such as a gas, air, or combination, and the like. In preferred embodiments, the fluid is air or a liquid or gas, such as nitrogen, argon, or combinations of gases. In a specific embodiment, the lower dielectric constant leads to a lower capacitance and higher resonating frequency. Additionally, higher resonating frequencies can include 1 GHz and less or 500 MHz and less, but can be others. Furthermore, the waveguide body is preferably less than about five inches (or two inches) in width and five inches (two inches) in length, but can be other dimensions. Of course, there can be other variations, modifications, and alternatives.

In a preferred embodiment, the microwave radiation source 115 feeds the waveguide 103 microwave energy via the feed 117. The waveguide contains and guides the microwave energy to a cavity 105 preferably located on an opposing side of the waveguide 103 from the feed 117. Disposed within the cavity 105 is the bulb 107 containing the gas-fill. Microwave energy is preferably directed into the enclosed cavity 105, and in turn the bulb 107. This microwave energy generally frees electrons from their normal state and thereby transforms the noble gas into a plasma. The free electrons of the noble gas excite the light emitter. The de-excitation of the light emitter results in the emission of light. As will become apparent, the different embodiments of DWIPLs disclosed herein offer distinct advantages over the plasma lamps in the prior art, such as an ability to produce brighter and spectrally more stable light, greater energy efficiency, smaller overall lamp sizes, and longer useful life spans.

The microwave source 115 in FIG. 1 is shown schematically as solid state electronics, however, other devices commonly known in the art that can operate in the 0.5-30 GHz range may also be used as a microwave source, including but not limited to klystrons and magnetrons. The preferred range for the microwave source is from about 100 MHz to about 20 GHz. More preferably, the frequency range is 300 MHz to less than 1 GHz. Of course, there can be other variations, modifications, and alternatives.

Depending upon the heat sensitivity of the microwave source 115, the microwave source 115 may be thermally isolated from the bulb 107, which during operation preferably reaches temperatures between about 700 Degree C. and about 1000 Degree C. Thermal isolation of the bulb 107 from the source 115 provides a benefit of avoiding degradation of the source 115. Additional thermal isolation of the microwave source 115 may be accomplished by any one of a number of methods commonly known in the art, including but not limited to using an insulating material or vacuum gap occupying an optional space 116 between the source 115 and waveguide 103. If the latter option is chosen, appropriate microwave feeds are used to couple the microwave source 115 to the waveguide 103.

In FIG. 1, the feed 117 that transports microwaves from the source 115 to the waveguide 103 preferably comprises a coaxial probe. However, any one of several different types of microwave feeds commonly known in the art maybe used, such as micro strip lines or fin line structures.

Due to mechanical and other considerations such as heat, vibration, aging, or shock, when feeding microwave signals into a dielectric material, contact between the feed 117 and the waveguide 103 is preferably maintained using a positive contact mechanism 121. The contact mechanism 121 provides constant pressure between the feed 117 and the waveguide 103 to minimize the probability that microwave energy will be reflected back through the feed 117 and not transmitted into the waveguide 103. In providing constant pressure, the contact mechanism 121 compensates for small dimensional changes in the microwave feed 117 and the waveguide 103 that may occur due to thermal heating or mechanical shock. The contact mechanism may be a spring loaded device, such as is illustrated in FIG. 1, a bellows type device, or any other device commonly known in the art that can sustain a constant pressure for continuously and steadily transferring microwave energy.

When coupling the feed 117 to the waveguide 103, intimate contact is preferably made by depositing a metallic material 123 directly on the waveguide 103 at its point of contact with the feed 117. The metallic material 123 eliminates gaps that may disturb the coupling and is preferably comprised of gold, silver, or platinum, although other conductive materials may also be used. The metallic material 123 may be deposited using any one of several methods commonly known in the art, such as depositing the metallic material 123 as a liquid and then firing it in an oven to provide a solid contact.

In FIG. 1, the waveguide 103 is preferably the shape of a rectangular prism, however, the waveguide 103 may also have a cylindrical prism shape, a sphere-like shape, or any other shape, including a complex, irregular shape the resonant frequencies of which are preferably determined through electromagnetic simulation tools, that can efficiently guide microwave energy from the feed 117 to the bulb 107. The actual dimensions of the waveguide may vary depending upon the frequency of the microwave energy used and the dielectric constant of the body of waveguide 103.

In one preferred embodiment, the waveguide body is approximately three inches or less with a dielectric constant of approximately 2 and less and operating frequency of approximately 400 MHz. Waveguide bodies, using the two dielectric materials, on this scale are significantly smaller than the waveguides in the conventional plasma lamps. As such, the waveguides in the preferred embodiments represent a significant advance over the conventional lamp because the smaller size allows the waveguide to be used in many applications, where waveguide size had previously prohibited such use or made such use wholly impractical. In a preferred embodiment, the present method and structure provides one or more benefits of a reduction in size, size reduction translates into a higher power density, lower loss, and thereby, an ease in igniting the lamp. Of course, there can be other variations, modifications, and alternatives.

Regardless of its shape and size, the waveguide 103 preferably has a body comprising a dielectric material which, for example, preferably exhibits the following properties; a dielectric constant preferably equal to or less than approximately 2; and a loss tangent preferably less than approximately 0.0001. In other embodiments, the dielectric constant is equal to or greater than 2. Of course, there can be other variations, modifications, and alternatives.

Certain ceramics, including alumina, zirconia, titanates, and variants or combinations of these materials, and silicone oil may satisfy many of the above preferences, and may be used because of their electrical and thermo-mechanical properties. In any event, it should be noted that the embodiments presented herein are not limited to a waveguide exhibiting all or even most of the foregoing properties. In preferred embodiments, the ceramic or dielectric includes one or more voids and/or air pockets that have an average dielectric constant of less than 2, but can be other materials. In other embodiments, the dielectric constant is equal to or greater than 2. Of course, there can be other variations, modifications, and alternatives.

In the various embodiments of the waveguide disclosed herein, such as in the example outlined above, the waveguide preferably provides a substantial thermal mass, which aids efficient distribution and dissipation of heat and provides thermal isolation between the lamp and the microwave source.

Figure 2B:
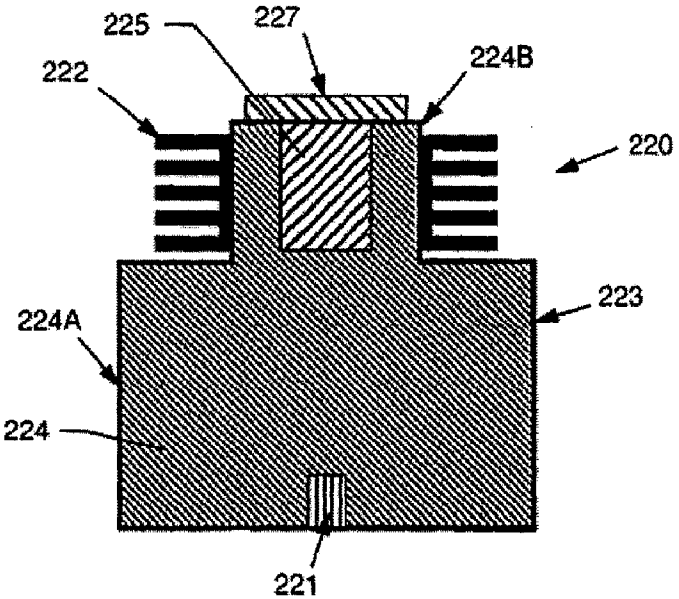
FIGS. 2A and 2B illustrate sectional views of alternative embodiments of a plasma lamp.
Figure 2A:
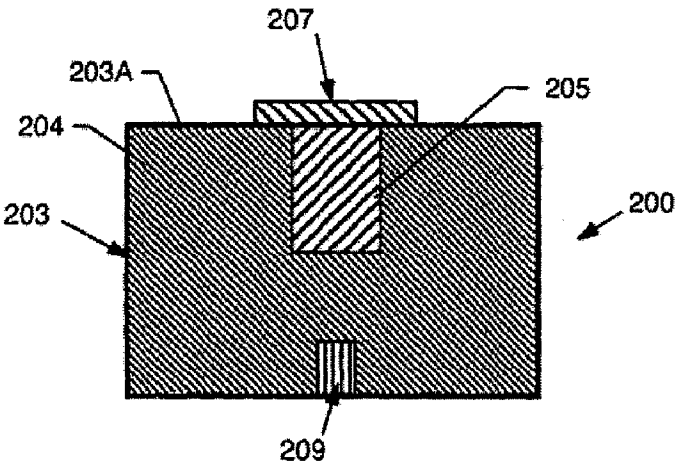

Alternative embodiments of DWIPLS 200, 220 are depicted in FIGS. 2A-B. In FIG. 2A, a bulb 207 and bulb cavity 205 are provided on one side of a waveguide 203, preferably on a side opposite a feed 209, and more preferably in the same plane as the feed 209, where the electric field of the microwave energy is at a maximum. Where more than one maximum of the electric field is provided in the waveguide 203, the bulb 207 and bulb cavity 205 may be positioned at one maximum and the feed 209 at another maximum. By placing the feed 209 and bulb 207 at a maximum for the electric field, a maximum amount of energy is respectively transferred and intercepted. The bulb cavity 205 is a concave form in the body of the waveguide 203.

As shown in FIG. 2B, the body of the waveguide 223 optionally protrudes outwards in a convex form, from the main part of the body of the waveguide 203 to form the bulb cavity 225. As in FIG. 2A, in FIG. 2B, the bulb 227 is preferably positioned opposite to the feed 221. However, where more than one electric field maximum is provided in the waveguide 203, the bulb 207, 227 may be positioned in a plane other than the plane of the feed 209, 221.

Returning to FIG. 1, the outer surfaces of the waveguide 103, with the exception of those surfaces forming the bulb cavity 105, are preferably coated with a thin metallic coating 119 to reflect the microwaves. The overall reflectivity of the coating 119 determines the level of energy contained within the waveguide 103. The more energy that can be stored within the waveguide 103, the greater the overall efficiency of the lamp 101. The coating 119 also preferably suppresses evanescent radiation leakage. In general, the coating 119 preferably significantly eliminates any stray microwave field.

Microwave leakage from the bulb cavity 105 may be significantly attenuated by having a cavity 105 that is preferably significantly smaller than the microwave wavelengths used to operate the lamp 101. For example, the length of the diagonal for the window is preferably considerably less than half of the microwave wavelength (in free space) used.

The bulb 107 is disposed within the bulb cavity 105, and preferably comprises an outer wall 109 and a window 111. In one preferred embodiment, the cavity wall of the body of the waveguide 103 acts as the outer wall of the bulb 107. The components of the bulb 107 preferably include one or more dielectric materials, such as ceramics and sapphires. In one embodiment, the ceramics in the bulb are the same as the material used in waveguide 103. Dielectric materials are preferred for the bulb 107 because the bulb 107 is preferably surrounded by the dielectric body of the waveguide 103 and the dielectric materials help ensure efficient coupling of the microwave energy with the gas-fill in the bulb 107.

The outer wall 109 is preferably coupled to the window 111 using a seal 113, thereby defining a bulb envelope 127 which contains the gas-fill comprising the plasma-forming gas and light emitter. The plasma-forming gas is preferably a noble gas, which enables the formation of a plasma. The light emitter is preferably a vapor formed of any one of a number of elements or compounds currently known in the art, such as sulfur, selenium, a compound containing sulfur or selenium, or any one of a number of metal halides, such as indium bromide ($InBr_3$).

To assist in confining the gas-fill within the bulb 107, the seal 113 preferably comprises a hermetic seal. The outer wall 109 preferably comprises alumina because of its white color, temperature stability, low porosity, and thermal expansion coefficient. However, other materials that generally provide one or more of these properties may be used. The outer wall 109 is also preferably contoured to reflect a maximum amount of light out of the cavity 105 through the window 111. For instance, the outer wall 109 may have a parabolic contour to reflect light generated in the bulb 107 out through the window 111. However, other outer wall contours or configurations that facilitate directing light out through the window 111 may be used.

The window 111 preferably comprises sapphire for light transmittance and because it's thermal expansion coefficient matches well with alumina. Other materials that have a similar light transmittance and thermal expansion coefficient may be used for the window 111. In an alternative embodiment, the window 111 may comprise a lens to collect the emitted light.

As referenced above, during operation, the bulb 107 may reach temperatures of up to about 1000 Degrees Celsius, or slightly less. Under such conditions, the waveguide 103 in one embodiment acts as a heat sink for the bulb 107. By reducing the heat load and heat-induced stress upon the various components of the DWIPL 101, the useful life span of the DWIPL 101 is generally increased beyond the life span of typical electrodeless lamps. Effective heat dissipation may be obtained by preferably placing heat-sinking fins 125 around the outer surfaces of the waveguide 103, as depicted in FIG. 1. In the embodiment shown in FIG. 2B, with the cavity 225 extending away from the main part of the body of the waveguide 223, the DWIPL 220 may be used advantageously to remove heat more efficiently by placing fins 222 in closer proximity to the bulb 227.

In another embodiment, the body of the waveguide 103 comprises a dielectric, such as a titanate, which is generally not stable at high temperatures. In this embodiment, the waveguide 103 is preferably shielded from the heat generated in the bulb 107 by placing a thermal barrier between the body of the waveguide 103 and the bulb 107. In one alternative embodiment, the outer wall 109 acts as a thermal barrier by comprising a material with low thermal conductivity such as NZP, commonly known as sodium zirconium phosphate. Other suitable material for a thermal barrier may also be used.

Figures 3A, 3B:
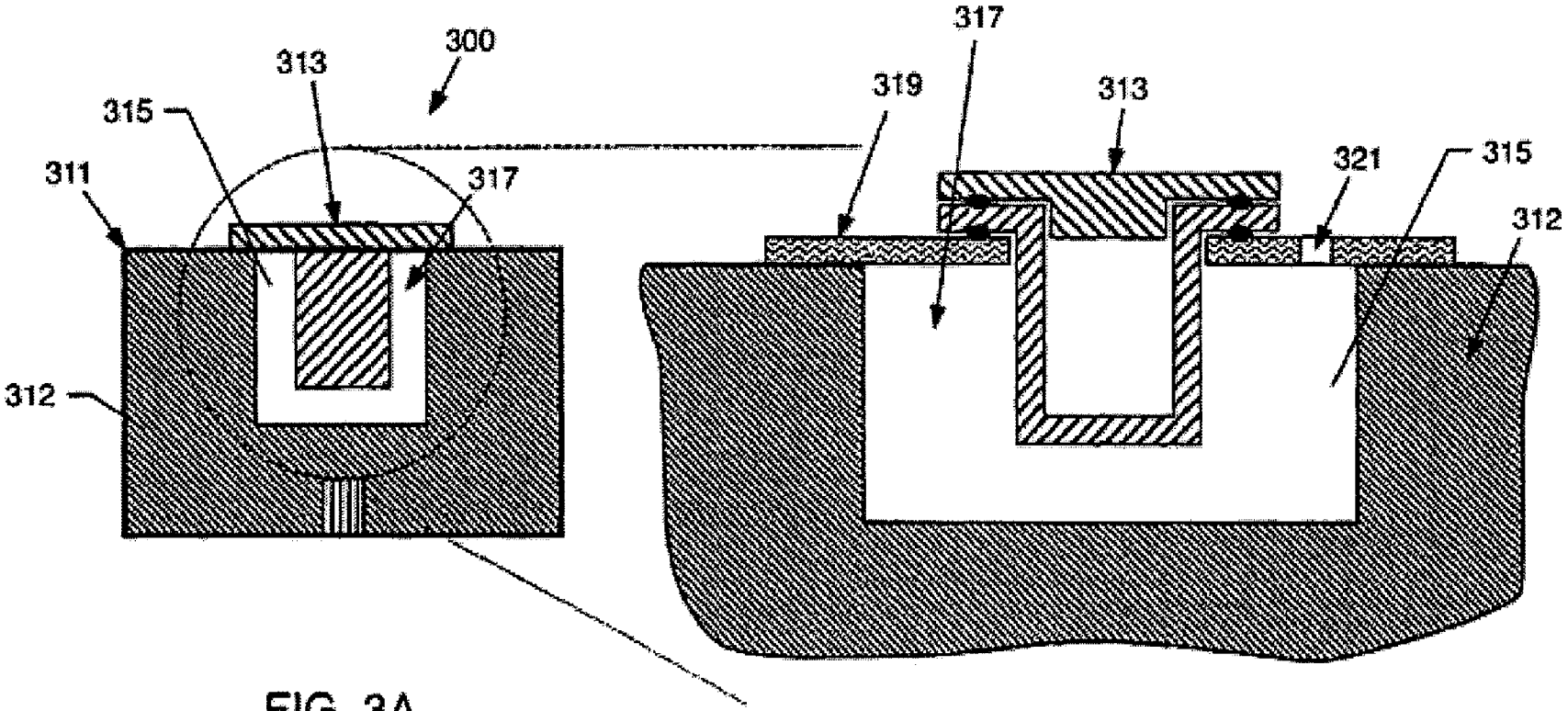
FIGS. 3A and 3B illustrate a sectional view of an alternative embodiment of a plasma lamp wherein the bulb is thermally isolated from the dielectric waveguide.

FIGS. 3A and 3B illustrate an alternative embodiment of a DWIPL 300 wherein a vacuum gap acts as a thermal barrier. As shown in FIG. 3A, the bulb 313 of the DWIPL 300 is disposed within a bulb cavity 315 and is separated from the waveguide 311 by a gap 317, the thickness of which preferably varies depending upon the microwave propagation characteristics and material strength of the material used for the body of the waveguide 311 and the bulb 313. The gap 317 is preferably a vacuum, minimizing heat transfer between the bulb 313 and the waveguide 311.

FIG. 3B illustrates a magnified view of the bulb 313, bulb cavity 315, and vacuum gap 317 for the DWIPL 300. The boundaries of the vacuum gap 317 are formed by the waveguide 311, a bulb support 319, and the bulb 313. The bulb support 319 may be sealed to the waveguide 311, the support 319 extending over the edges of the bulb cavity 315 and comprising a material such as alumina that preferably has high thermal conductivity to help dissipate heat from the bulb 313. Further details of the present apparatus can be found with reference to FIGS. 7. 8. and 9 below.

Figure 7:
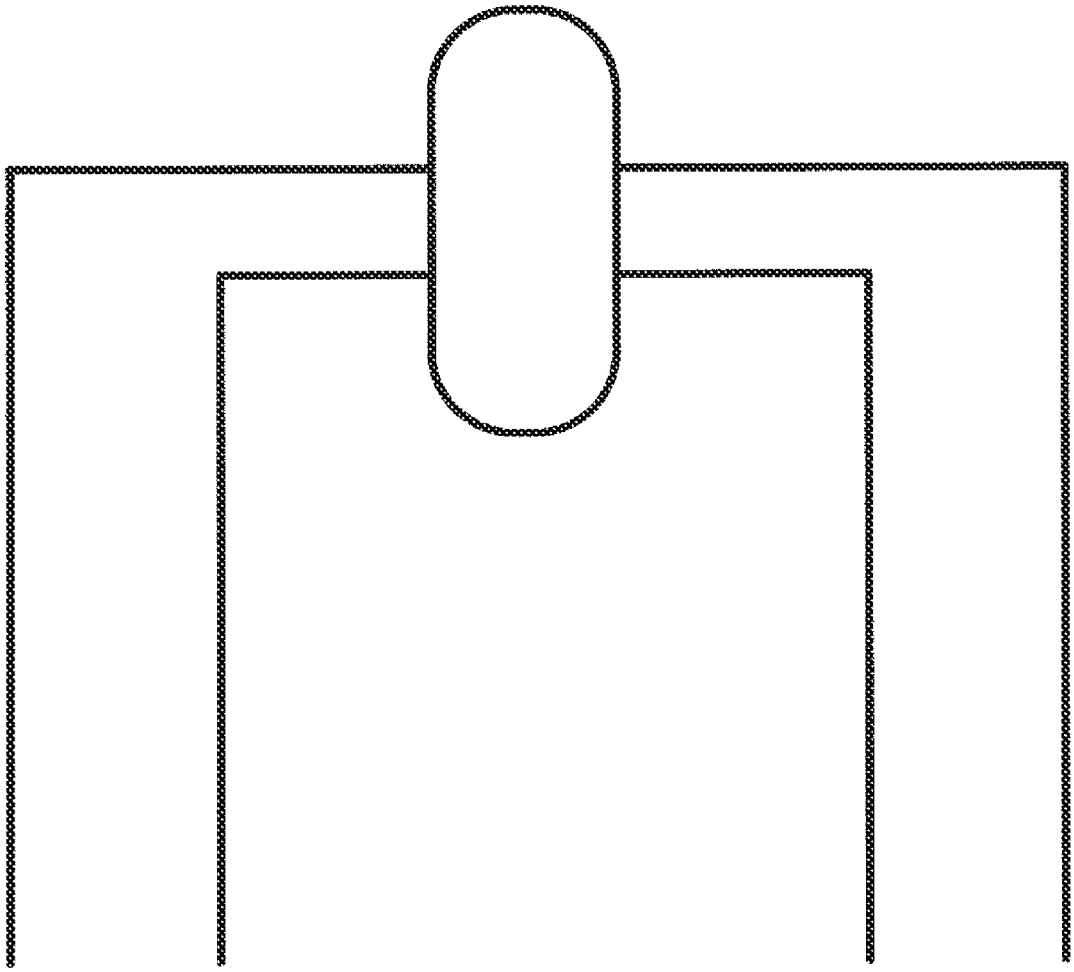
Figure 7 (PRIOR ART)
FIG. 7 is a simplified cross sectional view of the conventional bulb and dielectric support structure.
Figure 9:
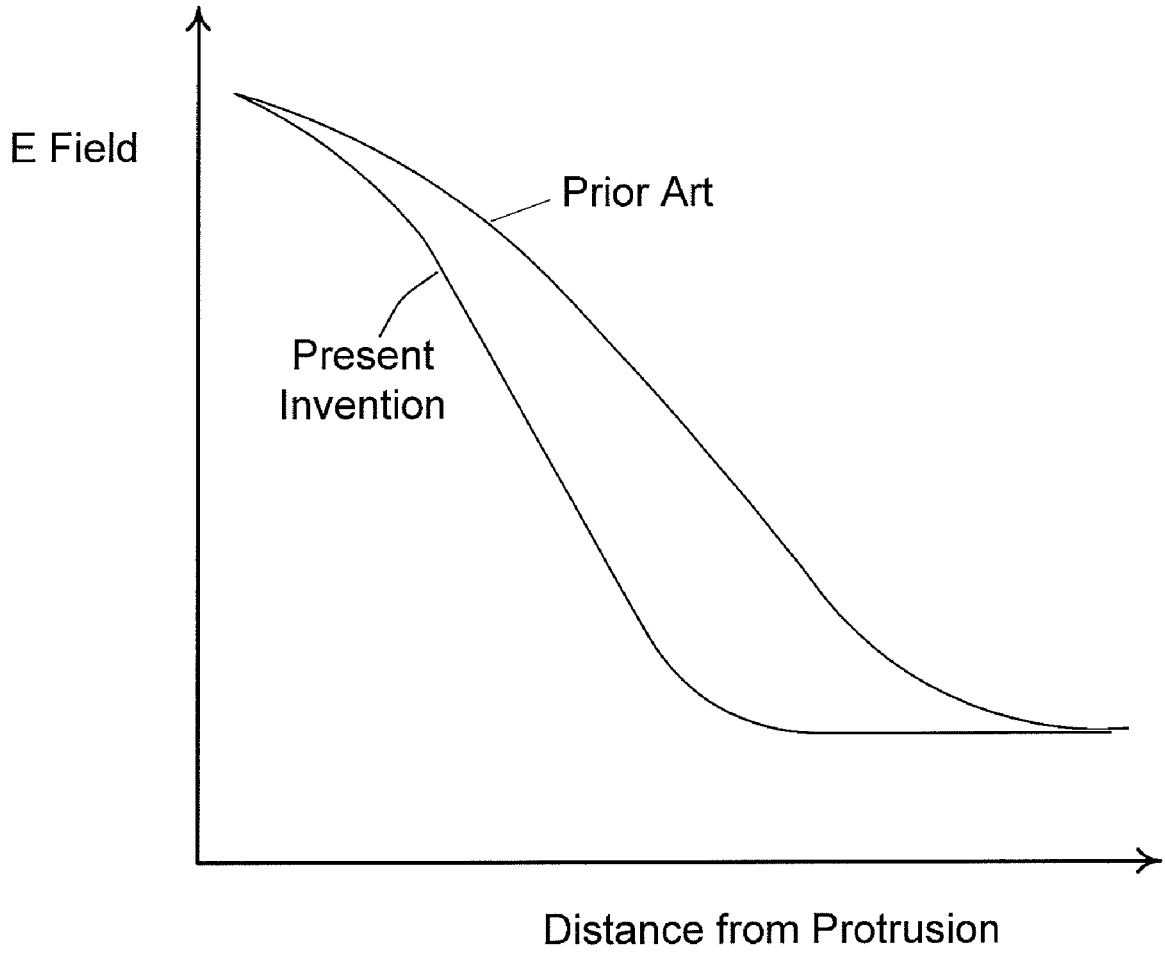
FIG. 9 is a diagram of the electric field within the support structure as a function of the distance away from the protrusion.

FIG. 7 shows a cross sectional view of the conventional bulb support assembly. The support assembly includes a support structure made from a dielectric material. The support structure includes a cavity for receiving the bulb. The bulb is held in place within the cavity through a protrusion that extends out from the support structure into the cavity and makes contact along the periphery of the bulb. The protrusion extends out from the support structure at an angle of ninety degrees. Because of the ninety degree angle at which the protrusion extends from, a large electric field is created within the support structure. This increase in electric field in the invention of the prior art as a function of the distance away from the protrusion, is shown in FIG. 9. The increased electric field, subsequently leads to an increased resonant frequency of the resonating structure including the support assembly. The increase in resonant frequency, in turn leads to an increased amount of RF power required to drive the device to the resonant frequency. This increased power consumption, subsequently lowers the lumens per watt characteristics of the lamp apparatus, thereby making the lamp less efficient.

Figure 8:
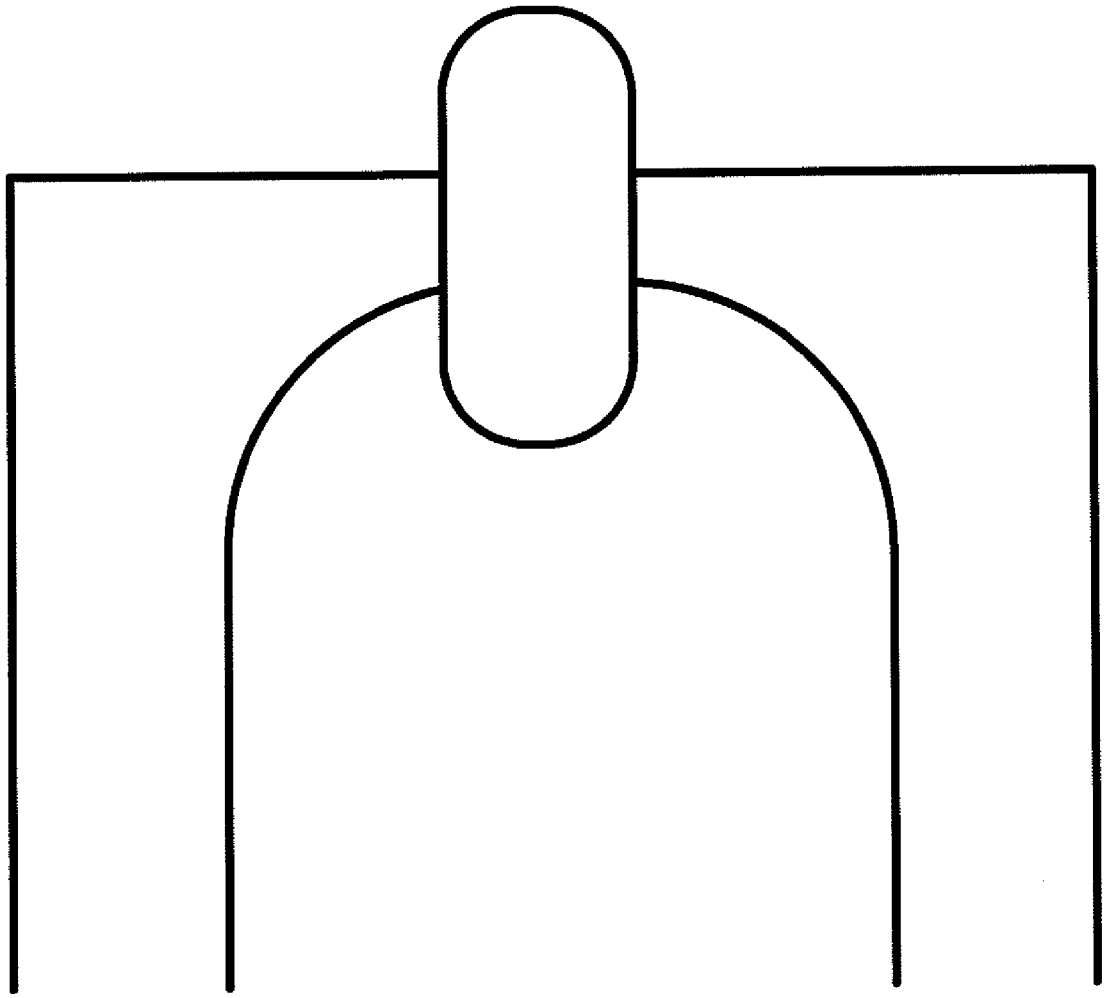
FIG. 8 is a simplified cross sectional view of the bulb and the dielectric support structure where the protruding portion used to support the bulb extends from the dielectric support structure at an angle according to an embodiment of the present invention.

FIG. 8 shows a cross sectional view of the bulb support assembly of the present invention. The support assembly, as with the prior art, includes a support structure made from a dielectric material, and a cavity formed within the support structure for receiving the bulb. The bulb is held in the cavity through a protrusion that extends out from the cavity and makes contact along the periphery of the bulb. The protrusion unlike the prior art extends out along a curve instead of at a ninety degree angle. In using a curved protrusion, a large electric field is not generated within the support structure. In reducing the electric field through the support structure, the resonant frequency of the resonant structure, including the support structure is lowered. In lowering the resonant frequency of the resonant structure, the lamp can be driven with lower RF power levels. Lower RF drive power levels, in turn increases the lumens per watt characteristic of the lamp apparatus, and subsequently improving efficiency.

Embedded in the support 319 is an access seal 321 for establishing a vacuum within the gap 317 when the bulb 313 is in place. The bulb 313 is preferably supported by and hermetically sealed to the bulb support 319. Once a vacuum is established in the gap 317, heat transfers between the bulb 313 and the waveguide 311 are preferably substantially reduced.

Embodiments of the DWIPLs thus far described preferably operate at a microwave frequency in the range of 0.5-10 GHz. The operating frequency preferably excites one or more resonant modes supported by the size and shape of the waveguide, thereby establishing one or more electric field maxima within the waveguide. When used as a resonant cavity, at least one dimension of the waveguide is preferably an integer number of half-wavelengths long.

Figure 4C:
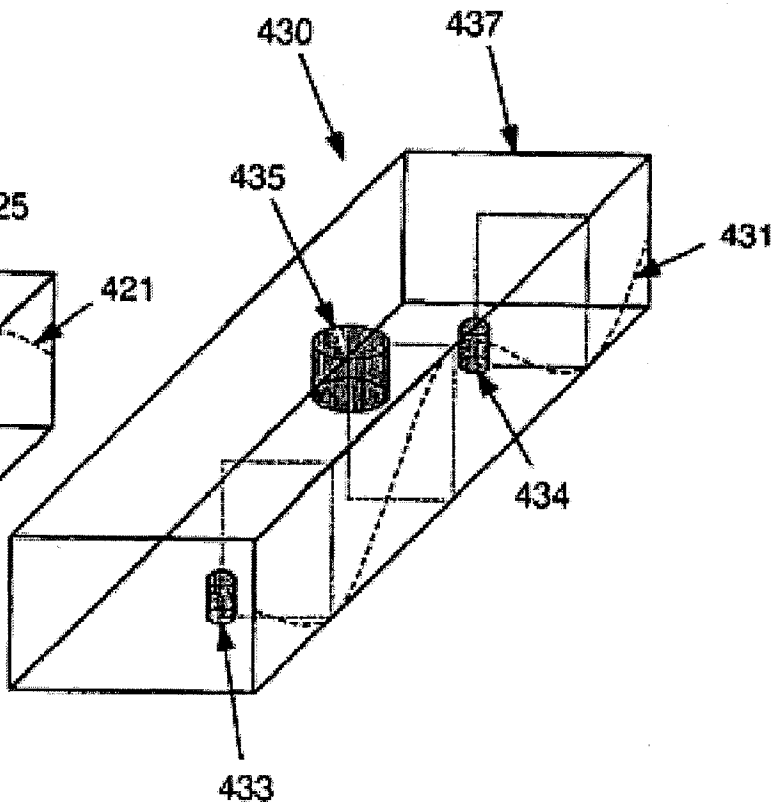
FIGS. 4A-D illustrate different resonant modes within a rectangular prism-shaped waveguide.
Figure 4B:
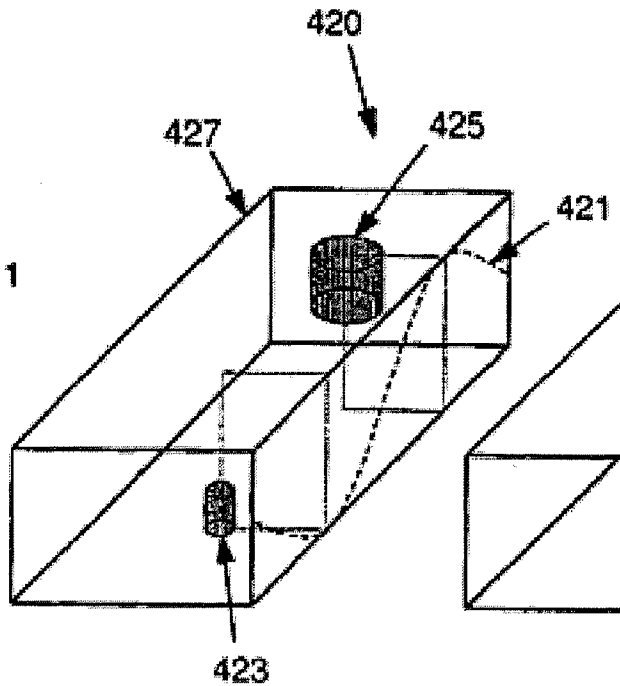
Figure 4A:
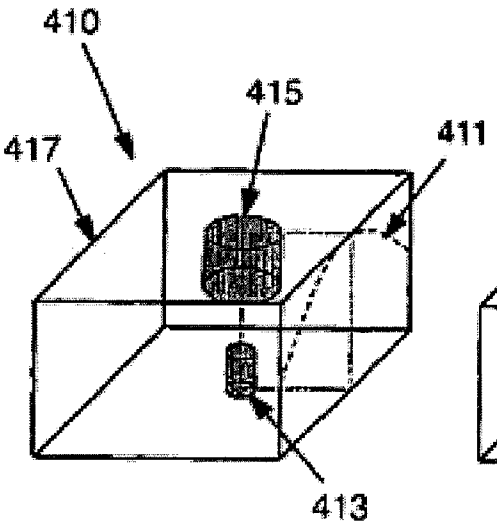

FIGS. 4A-C illustrate three alternative embodiments of DWIPLs 410, 420, 430 operating in different resonant modes. FIG. 4A illustrates a DWIPL 410 operating in a first resonant mode 411 where one axis of a rectangular prism-shaped waveguide 417 has a length that is one-half the wavelength of the microwave energy used. FIG. 4B illustrates a DWIPL 420 operating in a resonant mode 421 where one axis of a rectangular prism-shaped waveguide 427 has a length that is equal to one wavelength of the microwave energy used. FIG. 4C illustrates a DWIPL 430 operating in a resonant mode 431 where one axis of a rectangular prism-shaped waveguide 437 has a length that is 1½ wavelengths of the microwave energy used.

In each of the DWIPLs and corresponding modes depicted in FIGS. 4A-C, and for DWIPLs operating at any higher modes, the bulb cavity 415, 425, 435 and the feed(s) 413, 423, 433, 434 are preferably positioned with respect to the waveguide 417, 427, 437 at locations where the electric fields are at an operational maximum. However, the bulb cavity and the feed do not necessarily have to lie in the same plane.

FIG. 4C illustrates an additional embodiment of a DWIPL 430 wherein two feeds 433, 434 are used to supply energy to the waveguide 437. The two feeds 433, 434 may be coupled to a single microwave source or multiple sources (not shown).

Figure 4D:
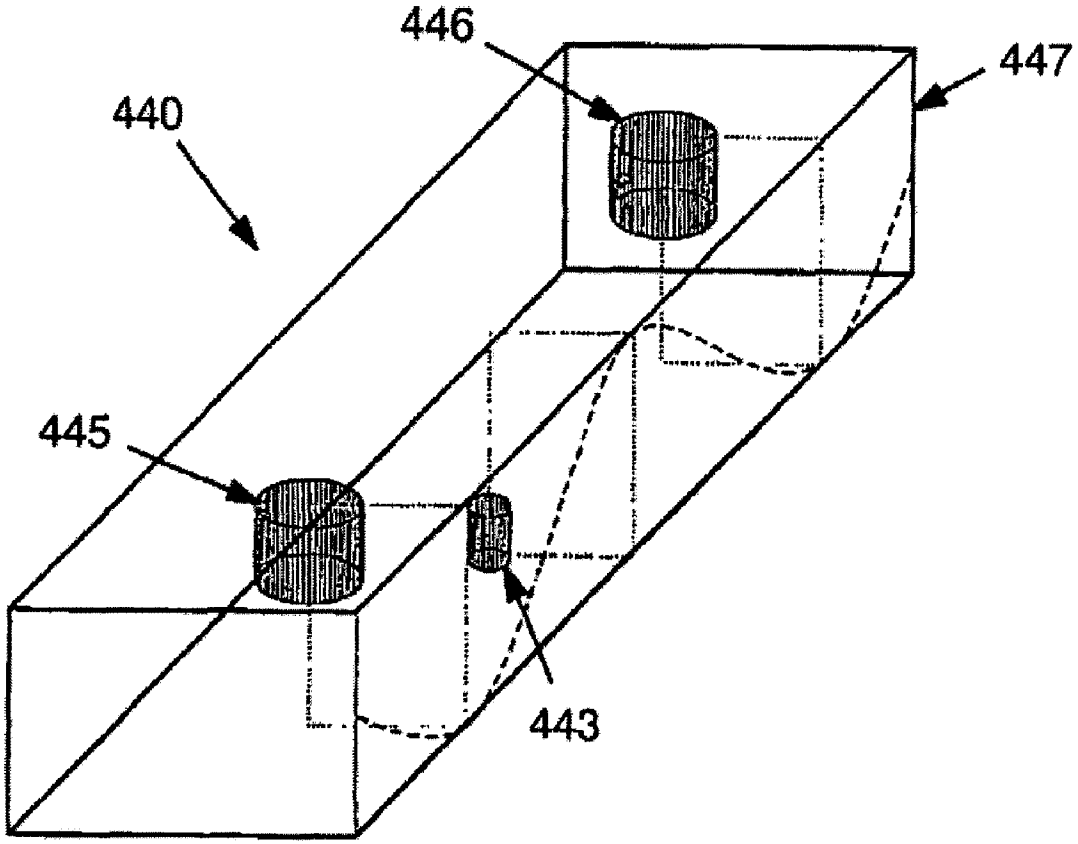

FIG. 4D illustrates another embodiment wherein a single energy feed 443 supplies energy into the waveguide 447 having multiple bulb cavities 415, 416, each positioned with respect to the waveguide 447 at locations where the electric field is at a maximum.

Figure 5C:
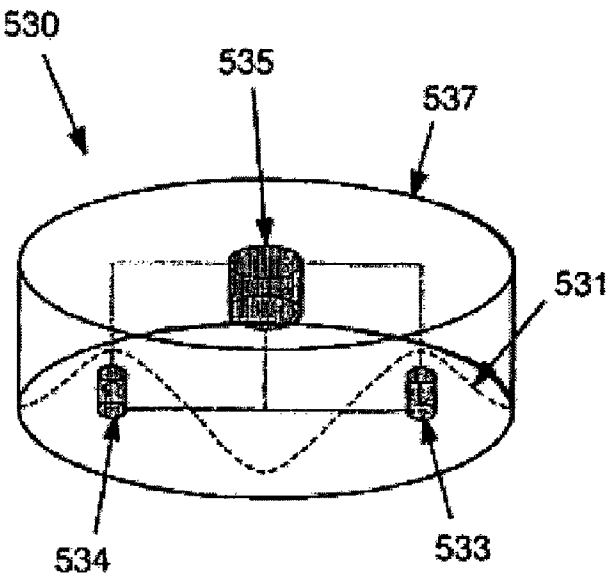
FIGS. 5A-C illustrate different resonant modes within using a cylindrical prism-shaped cylindrical waveguide.
Figure 5B:
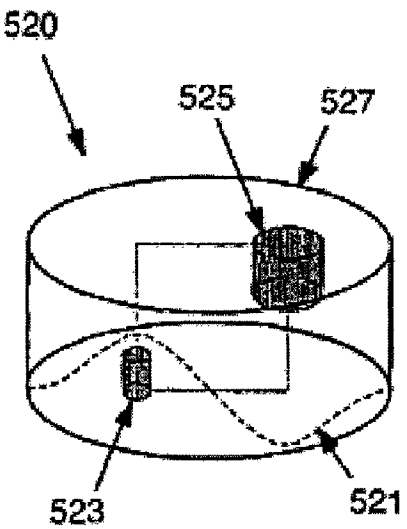
Figure 5A:
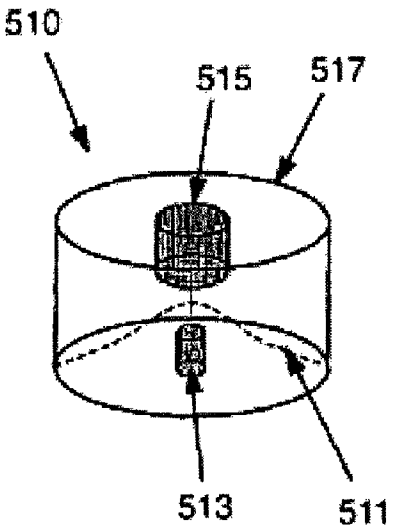

FIGS. 5A-C illustrate DWIPLs 510, 520, 530 having cylindrical prism-shaped waveguides 517, 527, 537. In the embodiments depicted in FIGS. 5A-C, the height of the cylinder is preferably less than its diameter, the diameter preferably being close to an integer multiple of the lowest order half-wavelength of energy that can resonate within the waveguide 517, 527, 537. Placing such a dimensional restriction on the cylinder results in the lowest resonant mode being independent of the height of the cylinder. The diameter of the cylinder thereby dictates the fundamental mode of the energy within the waveguide 517, 527, 537. The height of the cylinder can therefore be optimized for other requirements such as size and heat dissipation. In FIG. 5A, the feed 513 is preferably positioned directly opposite the bulb cavity 515 and the zeroeth order Bessel mode 511 is preferably excited.

Other modes may also be excited within a cylindrical prism-shaped waveguide. For example, FIG. 5B illustrates a DWIPL 520 operating in a resonant mode where the cylinder 527 has a diameter that is preferably close to one wavelength of the microwave energy used.

As another example, FIG. 5C illustrates a DWIPL 520 operating in a resonant mode where the cylinder 537 has a diameter that is preferably close to ½ wavelengths of the microwave energy used. FIG. 5C additionally illustrates an embodiment of a DWIPL 530 whereby two feeds 533, 534 are used to supply energy to the cylinder-shaped waveguide 537. As with other embodiments of the DWIPL, in a DWIPL having a cylinder-shaped waveguide, the bulb cavity 515, 525, 535 and the feed(s) 513, 523, 533, 534 are preferably positioned with respect to the waveguide 517, 527, 537 at locations where the electric field is at a maximum.

Using a dielectric waveguide has several distinct advantages. First, as discussed above, the waveguide may be used to help dissipate the heat generated in the bulb. Second, higher power densities may be achieved within a dielectric waveguide than are possible in the plasma lamps with air cavities that are currently used in the art. The energy density of a dielectric waveguide is greater, depending on the dielectric constant of the material used for the waveguide, than the energy density of an air cavity plasma lamp.

Referring back to the DWIPL 101 of FIG. 1, high resonant energy within the waveguide 103, corresponding to a high value for Q (where Q is the ratio of the operating frequency to the frequency width of the resonance) for the waveguide results in a high evanescent leakage of microwave energy into the bulb cavity 105. High leakage in the bulb cavity 105 leads to the quasi-static breakdown of the noble gas within the envelope 127, thus generating the first free electrons. The oscillating energy of the free electrons scales as I.lamda-.sup.2, where I is the circulating intensity of the microwave energy and .lamda. is the wavelength of that energy. Therefore, the higher the microwave energy, the greater is the oscillating energy of the free electrons. By making the oscillating energy greater than the ionization potential of the gas, electron-neutral collisions result in efficient build-up of plasma density.

Once the plasma is formed in the DWIPL and the incoming power is absorbed, the waveguide's Q value drops due to the conductivity and absorption properties of the plasma. The drop in the Q value is generally due to a change in the impedance of the waveguide. After plasma formation, the presence of the plasma in the cavity makes the bulb cavity absorptive to the resonant energy, thus changing the overall impedance of the waveguide. This change in impedance is effectively a reduction in the overall reflectivity of the waveguide. Therefore, by matching the reflectivity of the feed close to the reduced reflectivity of the waveguide, a sufficiently high Q value may be obtained even after the plasma formation to sustain the plasma. Consequently, a relatively low net reflection back into the energy source may be realized.

Much of the energy absorbed by the plasma eventually appears as heat, such that the temperature of the lamp may approach 1000 Degrees Celsius, or slightly less. When the waveguide is also used as a heat sink, as previously described, the dimensions of the waveguide may change due to its coefficient of thermal expansion. Under such circumstances, when the waveguide expands, the microwave frequency that resonates within the waveguide changes and resonance is lost. In order for resonance to be maintained, the waveguide preferably has at least one dimension equal to an integer multiple of the half wavelength microwave frequency being generated by the microwave source.

One preferred embodiment of a DWIPL that compensates for this change in dimensions employs a waveguide comprising a dielectric material having a temperature coefficient for the refractive index that is approximately equal and opposite in sign to its temperature coefficient for thermal expansion. Using such a material, a change in dimensions due to thermal heating offsets the change in refractive index, minimizing the potential that the resonant mode of the cavity would be interrupted. Such materials include Titanates. A second embodiment that compensates for dimensional changes due to heat comprises physically tapering the walls of the waveguide in a predetermined manner.

Figure 6:
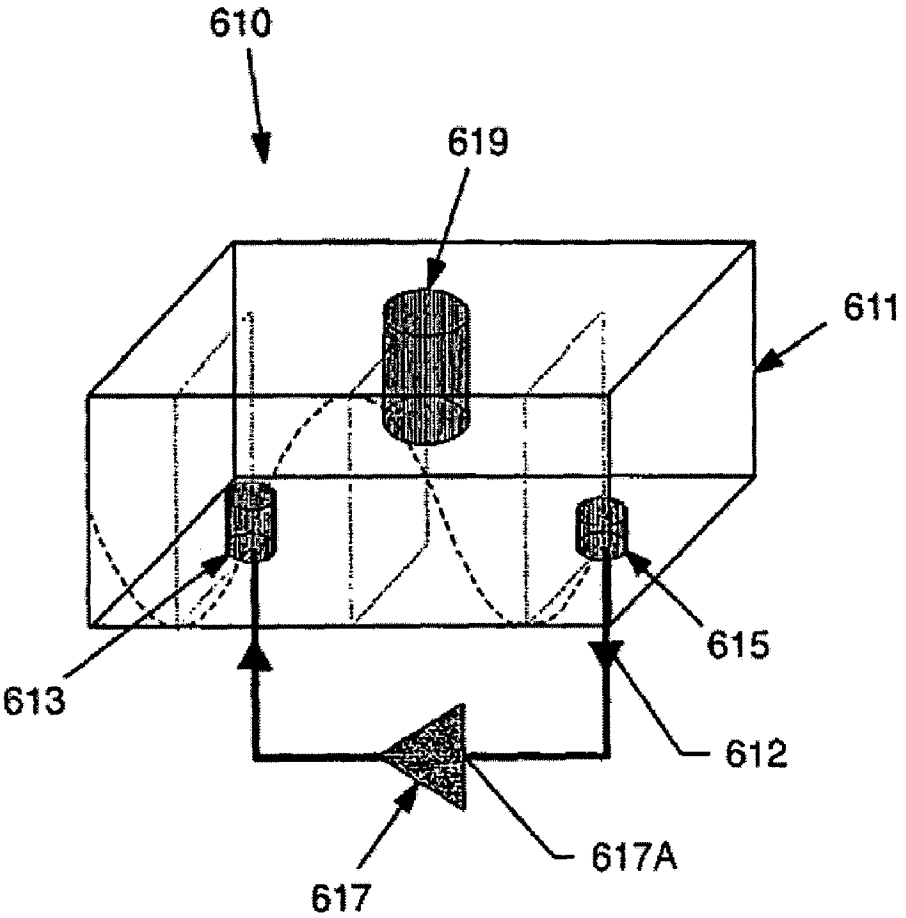
FIG. 6 illustrates an embodiment of the apparatus using a feedback mechanism to provide feedback to the microwave source to maintain a resonant mode of operation.

In another preferred embodiment, schematically shown in FIG. 6, a DWIPL 610 may be operated in a dielectric resonant oscillator mode. In this mode, first and second microwave feeds 613, 615 are coupled between the dielectric waveguide 611, which may be of any shape previously discussed, and the microwave energy source 617. The energy source 617 is preferably broadband with a high gain and high power output and capable of driving plasma to emission.

The first feed 613 may generally operate as described above in other embodiments. The second feed 615 may probe the waveguide 611 to sample the field (including the amplitude and phase information contained therein) present and provide its sample as feedback to an input of the energy source 617 or amplifier. In probing the waveguide 611, the second feed 615 also preferably acts to filter out stray frequencies, leaving only the resonant frequency within the waveguide 611.

In this embodiment, the first feed 613, second feed, 615 and bulb cavity 619 are each preferably positioned with respect to the waveguide 611 at locations where the electric field is at a maximum. Using the second feed 615, the energy source 617 amplifies the resonant energy within the waveguide 611. The source 617 thereby adjusts the frequency of its output to maintain one or more resonant modes in the waveguide 611. The complete configuration thus forms a resonant oscillator. In this manner, automatic compensation may be realized for frequency shifts due to plasma formation and thermal changes in dimension and the dielectric constant.

The dielectric resonant oscillator mode also enables the DWIPL 610 to have an immediate re-strike capability after being turned off. As previously discussed, the resonant frequency of the waveguide 611 may change due to thermal expansion or changes in the dielectric constant caused by heat generated during operation. When the DWIPL 610 is shutdown, heat is slowly dissipated, causing instantaneous changes in the resonant frequency of the waveguide 611.

However, as indicated above, in the resonant oscillator mode the energy source 617 automatically compensates for changes in the resonant frequency of the waveguide 611. Therefore, regardless of the startup characteristics of the waveguide 611, and providing that the energy source 617 has the requisite bandwidth, the energy source 617 will automatically compensate to achieve resonance within the waveguide 611. The energy source immediately provides power to the DWIPL at the optimum plasma-forming frequency.

While embodiments and advantages of this invention have been shown and described, it would be apparent to those skilled in the art that many more modifications are possible without departing from the inventive concepts herein. The invention, therefore, is not to be restricted except in the spirit of the appended claims.

While embodiments and advantages of this invention have been shown and described, it would be apparent to those skilled in the art that many more modifications are possible without departing from the inventive concepts herein. The invention, therefore, is not to be restricted except in the spirit of the appended claims.

What is claimed is:

1. A plasma lamp comprising:

a body comprising at least a dielectric material and having at least a main part with a first surface and a second surface opposed to the first surface;

a feed inserted through the first surface into the main part of the body and configured to provide radio frequency energy to the body;

a protruding portion of the dielectric material surrounding a periphery of a bulb, the bulb comprising a first end, a second end, and a spatial region between the first end and the second end, and a predefined volume, the bulb enclosing a gas fill positioned to receive the radio frequency energy from the body such that a substantial portion of the electric field is provided within a vicinity of the spatial region, the second surface coated with an electrically conductive material;

a shaped or rounded edge characterizing the protruding portion; and at least a portion of the bulb enclosing the gas fill positioned above the main part of the body adjacent to the second surface and an rf power source coupled to the second surface to provide radio frequency energy to the body to cause the gas fill to emit a substantial portion of electromagnetic radiation of at least a determined amount of lumens per watt through a portion of the spatial region.

2. The plasma lamp of claim 1 wherein the bulb is made of a translucent alumina material or sapphire material, wherein the radio frequency energy is in the range of 10 MHz to 10 GHz, cycled at about 400 to about 500 MHz.

3. The plasma lamp of claim 1 wherein the portion of the bulb enclosing the gas fill positioned above the main part of the body is one third or greater of a total spatial region.

4. The plasma lamp of claim 1 wherein the portion of the bulb enclosing the gas fill position above the main part of the body is one half or greater of a total spatial region.

5. The plasma lamp of claim 1 wherein the RF power source coupled to the second surface is coupled to a reference potential, wherein the radio frequency energy is substantially inductively coupled to the second surface of the body.

6. The plasma lamp of claim 1 wherein the spatial region is configured as a cylindrical shape, wherein the body of the dielectric material has a dielectric constant greater than 2.

7. The plasma lamp of claim 1 wherein the dielectric material is substantially glass or quartz.

8. The plasma lamp of claim 1 wherein the protruding portion of dielectric material protrudes from the main part of the solid body adjacent to the second surface and surrounds at least a portion of the bulb.

9. The plasma lamp of claim 1 further comprising a heat sink surrounding the protruding portion of solid dielectric material.

10. The plasma lamp of claim 1 further comprising: a power source adapted to provide radio frequency energy to the solid body through the feed at a frequency that resonates within the solid body.

11. The plasma lamp of claim 1 wherein the protruding portion of dielectric material is smaller than the main part of the solid body of dielectric material.

12. The plasma lamp of claim 1 wherein at least a portion of the bulb is positioned over a central region of the main part of the dielectric body.

13. The plasma lamp of claim 1 wherein the solid body forms an opening and at least a portion of the bulb is positioned in the opening.

14. The plasma lamp of claim 1 wherein the bulb is positioned above a plane that contains the second surface; wherein the dielectric material comprises alumina.

15. The plasma lamp of claim 1 further comprising: a power source adapted to provide radio frequency energy to the body through the feed at a frequency that resonates within the body in a fundamental mode, wherein the body forms an opening and at least a portion of the bulb is positioned in the opening.

16. The plasma lamp of claim 1 further comprising: a power source adapted to provide radio frequency energy to the body through the feed at a frequency that resonates within the body, wherein the body has at least one dimension equal to about one-half the wavelength of the resonant energy in the body.

17. The plasma lamp of claim 1 wherein the outer surfaces of the body other than the surfaces in the opening are substantially coated with an electrically conductive material, wherein the body forms an opening and at least a portion of the bulb is positioned in the opening.

18. The plasma lamp of claim 1 further comprising a second feed inserted into the body, wherein the second feed is adapted to obtain feedback from the body.

19. The plasma lamp of claim 1, further comprising: a power source adapted to provide radio frequency energy to the body through the feed at a frequency that resonates within the body; and a second feed inserted into the body adapted to sample radio frequency energy from the body, wherein the second feed is coupled to the power source to provide feedback to the power source from the solid body, and wherein the body forms an opening and at least a portion of the bulb is positioned in the opening.

* * * * *